United States Patent [19]

Lawson et al.

[11] 3,939,671

[45] Feb. 24, 1976

[54] MACHINE FOR KNITTING CORD-LIKE STRUCTURES

[75] Inventors: John B. Lawson, Providence, R.I.; Stephen C. Dangel, Cambridge, Mass.

[73] Assignee: Lawson-Hemphill, Inc., Central Falls, R.I.

[22] Filed: June 10, 1974

[21] Appl. No.: 477,927

[52] U.S. Cl. ..... 66/86 R; 66/125 R; 66/132 R

[51] Int. Cl.[2] ..... D04B 23/00; D04B 27/00

[58] Field of Search ..... 66/86, 1, 7, 202, 190–195, 66/132, 125 R

[56] References Cited

UNITED STATES PATENTS 1,740,650 12/1929 Holland ..... 66/202

2,006,275 6/1935 Meiwald ..... 66/169

FOREIGN PATENTS OR APPLICATIONS 285,099 2/1928 United Kingdom

*Primary Examiner*—Ronald Feldbaum

*Attorney, Agent, or Firm*—Miller, Frailey & Prestia

[57] ABSTRACT

A knitting machine is provided having one or more needles for knitting from one or more strands a variety of cord-like structures formed of one or more wales of knitted stitches. The machine is particularly useful for the manufacture of knitted yarns, either from strands of continuous or spun filaments or from a roving or sliver of staple fibers.

32 Claims, 15 Drawing Figures

XIII
XIV
XV
XIV
XV
XIII
255
254
259
238
212
260
122
119
90
222
230
228
226
256
268
214A
217
218
216
221
219
220
270
266
267
265
50
53
80
214A
272
264
62
66
242
250
71
68
200
204
240
210
206
202
208
214
244
256
268
272
256
257
255
214A
254
259
260
228
224
232
255
226
222
230

MACHINE FOR KNITTING CORD-LIKE STRUCTURES

SUMMARY OF THE INVENTION

This invention provides a new greatly simplified, highly versatile machine for knitting cord-like structures, such as knitted yarns. The invention eliminates the use of cams, complex mechanisms and heavy mass reciprocating parts which, in the past, have characterized machines for knitting yarns and have made such machines both difficult to build and cumbersome to operate.

Our new machine has a highly unique driving system, utilizing a single endless doubled and twisted timing belt for imparting, in timed relation, the strand delivery motions to the feeding guides and the knitting motions to the knitting instrumentalities. The new driving system, utilizing a single timing belt drive and a plurality of compound timing pulleys, makes possible selected, extremely accurate variations in the timing of the motions of both the feeding guides and needles, to provide a wide versatility of operation for the manufacture of a broad range of knitted cord-like structures.

The machine may include one or more needles in the needle cylinder, and one or more movable guides for feeding a plurality of strands selectively to the needles. The versatility is such as to permit more than one knitted cord-like product to be made simultaneously, by suitable adjustments of the timing and the relative movements between the movable feeding guides and the needles.

A pair of spaced co-axial timing idler pulleys are provided, having crank-like connections to the needles, to impart reciprocatory movement thereto. Reciprocatory and oscillatory movements are imparted to the strand feeding guides by means of a pair of spaced shafts operatively connected to the guides. The two shafts are each provided with timing pulleys, and have their axes disposed in a direction transverse to the common axis of the idler pulleys. The unique, doubled and twisted endless timing belt is entrained about all of the timing pulleys, whereby they rotate in timed relation to impart timed movements to the guides and needles to provide the necessary knitting motions.

The machine may be provided with positive yarn feeding means to meter the strands which are fed to the needles for formation of the knitted cord-like structures produced by the machine.

The machine of this invention is readily adaptable for the knitting of cord-like structures directly from a roving of staple fibers. To accomplish this, the machine may be equipped with suitable drafting means and a rotary feeding guide, driven from one of the shafts of the machine, for delivering the drafted sliver to the needle or needles, while imparting a false twist thereto. The resulting cord-like knitted structure, formed directly from sliver, is a unique yarn which, when knitted, woven or otherwise formed into fabric, provides a product of superior texture and "hand" qualities.

DETAILED DESCRIPTION OF THE INVENTION

Figure 1:
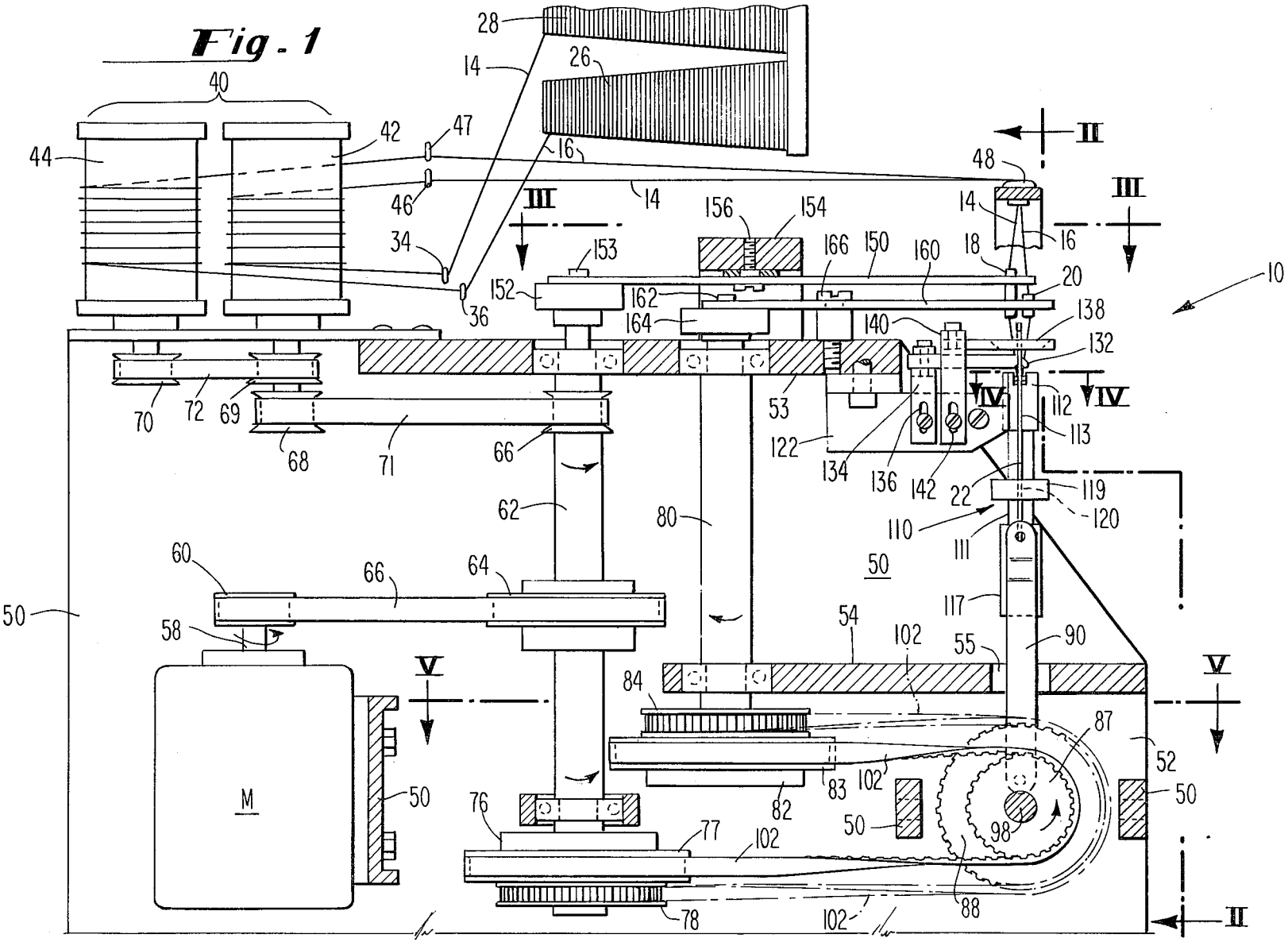
FIG. 1 is a partial view in side elevation showing a preferred embodiment of the knitting machine of this invention.

In FIGS. 1–5 there is illustrated a preferred knitting machine 10 of this invention for the continuous production of a knitted cord or yarn 12 from two separate strands 14, 16 delivered, respectively, by movable tubes or guides 18, 20 to a pair of vertically reciprocable needles 22, 24. The strands 14, 16 are drawn from supply packages 26, 28 respectively, via fixed guides 34, 36 by any suitable positive yarn feeding or metering system 40 for knitting machines, and are fed respectively, via fixed guides 46, 48 and 47, 49 to the tubes 18, 20 for delivery to the needles. The tubes 18, 20 reciprocate and oscillate in such a manner as to wrap the strands 14, 16 about the needles 22, 24 in timed relation to the reciprocation of the needles, to produce a two wale knitted yarn or cord-like structure 12. The knitted product 12 may be wound up on any conventional, suitably controlled, take-up mechanism (not shown). The machine 10 is supported by a frame 50.

The novel drive system of the knitting machine 10 includes electric motor M (FIG. 1) having an output shaft 58, to the end of which is secured a pulley 60. Spaced from the motor and supported by suitable bearings in the frame 50 is a vertical rotatable shaft 62 mounting a pulley 64. An endless drive belt 66 connects pulleys 60, 64, whereby the motor M imparts rotation to shaft 62. The positive yarn feeding means 40 is driven from the shaft 62 by means of a suitable drive sub-system including a timing pulley 66 mounted on shaft 62, timing pulleys 68, 69, 70, and timing belts 71, 72, to impart timed rotation to the individual drums 42, 44 of the positive yarn feeding means 40.

Affixed to the lower end of the shaft 62, for rotation therewith, is a compound timing pulley 76. In the embodiment shown, pulley 76 includes a large diameter toothed pulley element 77 and a small diameter toothed pulley element 78.

Mounted on the frame 50 between shaft 62 and the needles 22, 24 is a second bearing supported, vertical, rotatable shaft 80, which rotates in a direction opposite to the direction of rotation of shaft 62. Affixed to the lower end of shaft 80, for rotation therewith, is a compound timing pulley 82 having a large diameter toothed pulley element 83 and a small diameter toothed pulley element 84.

Figure 2:
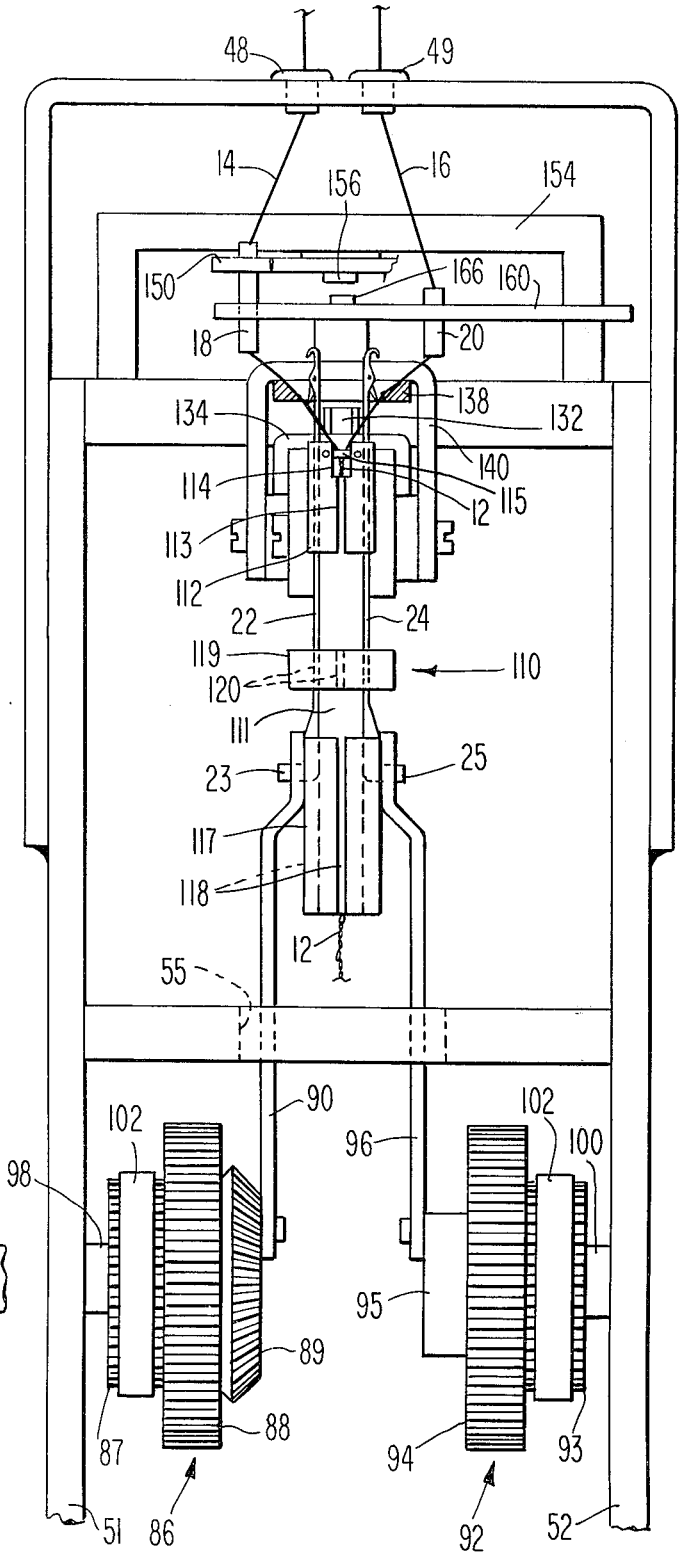
FIG. 2 is an enlarged view in front elevation, looking in the direction of the arrows II — II of FIG. 1.

Disposed forwardly of shaft 80, below the needles 22, 24, are a pair of spaced horizontal axis compound idler timing pulleys 86, 92. As best shown in FIG. 2, the pulleys 86, 92 are rotatable about co-axial stud shafts 98, 100 affixed, respectively, to the spaced sides 51, 52 of the frame 50 of the knitting machine. Idler pulley 86 consists of a small diameter toothed pulley element 87, a large diameter toothed pulley element 88 and a toothed bevel gear 89. Idler pulley 92 is composed of a small diameter toothed pulley element 93 and a large diameter toothed pulley element 94. The respective small and large toothed pulley elements of the timing idlers 86, 92 have the same size diameters and the same number of teeth disposed about their peripheries.

Figure 5:
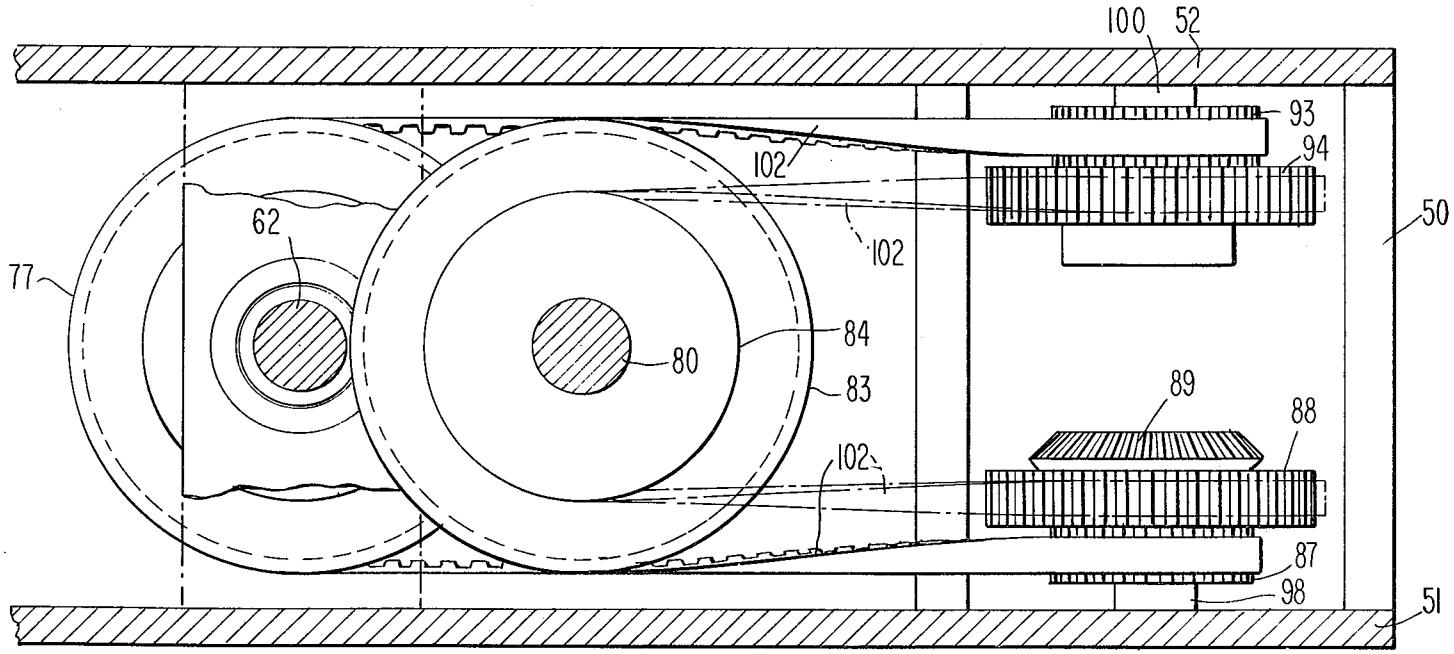
FIG. 5 is an enlarged fragmentary view in section indicated by the arrows V — V of FIG. 1.

A doubled and twisted endless toothed timing belt 102 (FIG. 1) connects drivingly the four timing pulleys 76, 86, 82, 92, whereby shaft 62 imparts rotation to the idler pulleys 86, 92 and vertical shaft 80. As will be readily understood, the relative speed of rotation of shafts 62, 80 and idler pulleys 86, 92 depends on the selection of the timing pulley elements about which the belt 102 is entrained. In FIGS. 1, 2 and 5 the timing belt 102 is shown entrained about the large pulley portions 77, 83 of the timing pulleys 76, 82, and about the small pulley portions 87, 93 of the idler pulleys 86, 92. With this arrangement, the idler pulleys 86, 92 rotate at a relatively high speed. When the timing belt 102 is entrained about the small diameter elements 78, 84 of the timing pulleys 76, 82, and about the large diameter elements 88, 94 of the idler pulleys 86, 92, as shown by the shadow lines in FIGS. 1 and 5, the idler pulleys rotate at a relatively slow speed. In the driving arrangement illustrated, the selection of the timing pulleys 76, 82, 86, 92, is such that, when the timing belt 102 is entrained as illustrated by the solid line arrangement of FIGS. 1, 2 and 5, the idler pulleys 86, 92 will rotate twice as fast as when the timing belt 102 is entrained as indicated by the broken lines in FIGS. 1 and 5.

Figure 4:
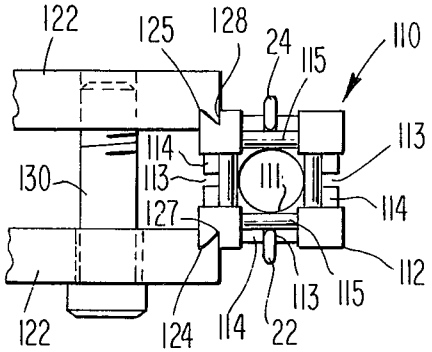
FIG. 4 is an enlarged fragmentary view showing the top of the needle cylinder, indicated by the arrows IV — IV of FIG. 1.

As best shown in FIGS. 1, 2 and 4, the needles are mounted for reciprocatory movement in a vertical needle cylinder 110. The needle cylinder consists of a hollow vertical tube 111 having force fitted on its upper end a rectangular hollow block 112. Each of the four outer faces of the block is provided with a vertical centrally located needle slot 113. The upper edge of each of the four faces of block 112 is provided with a vertical notch 114. Each needle slot 113 is coaxial with and merges into a notch 114. Disposed transversally of each notch is a bar 115, which serves as the verge of the needle cylinder 110 during cast-off of knitted loops from the needles, as they descend to cast-off level.

Figure 8:
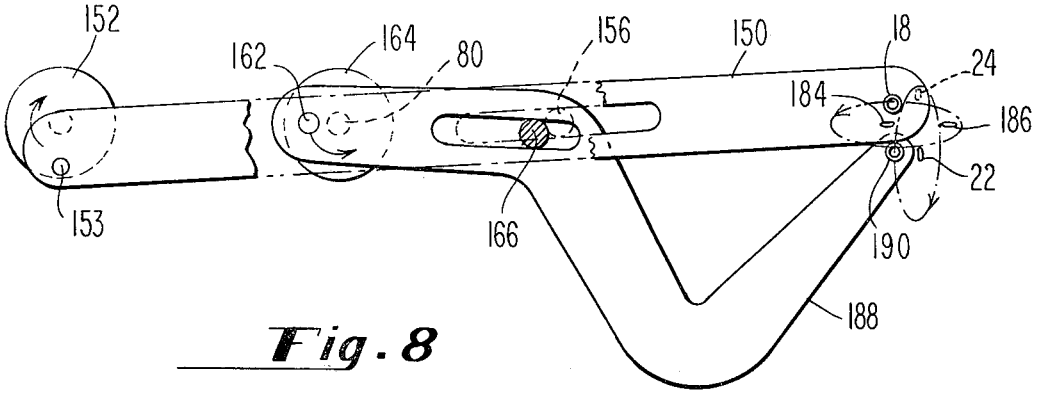
FIGS. 8 and 9 illustrate one manner in which a pair of yarn guides may feed strands to four needles.
Figure 9:
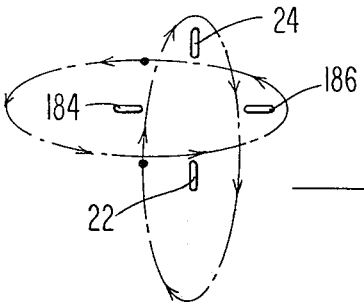

Affixed to the lower end of the tube 111, by a force fit, is a second hollow rectangular block 117. Formed in the middle of each rectangular face of block 117 is a vertical needle slot 118, each of which extends the full length of the block. Disposed about the hollow cylinder 111, intermediate of blocks 112 and 117, is a hollow clamp 119, on the inside of which are formed four vertical spaced needle slots 120. The four vertical needle slots in each of the blocks 112, 117 and in clamp 119 are spaced at 90° intervals about the needle cylinder tube. Each slot of each group of slots is aligned with one slot of each of the other two groups of slots, to provide vertical guides for the reciprocatory movement of the needles. The arrangement provides for a total of four needles, if desired, two disposed transversely of the machine 10 and two disposed longitudinally (FIGS. 8, 9). Each pair of opposing needles are disposed back-to-back, as illustrated in FIG. 2.

The needle cylinder is affixed to the frame of the machine by means of a cantilever bracket 122 bolted to the underside of the top portion 53 of the machine frame 50. As best shown in FIG. 4 the distal end of bracket 122 is bifurcated and each of the spaced bifurcations, are provided, on their opposing inner faces, with vertically extending angular grooves 124, 125. These grooves mate or dovetail with complementary, vertically extending, angular grooves 127, 128 formed in the rear portions of the lateral faces of block 112. A threaded bolt 130 passing through the spaced bifurcations of bracket 122 secures block 112, and hence the needle cylinder 110, in place. By means of the dovetail mounting of block 112 to the distal end of the bracket 122, it is possible upon loosening bolt 130, to raise or lower the needle cylinder 110 as desired or required.

Spaced vertically a small distance above block 112 is the slotted distal end of a web holder or sinker 132 (FIG. 1). The proximal end of the web holder 132 is bolted to a yoke 134, the spaced depending legs of which are bolted to the outside surfaces of the bracket 122. Vertically elongated slots 136 formed in the spaced legs of the yoke 134 permit its elective vertical adjustment, with consequent vertical adjustment of the web holder 132, as desired or required. The distal end of the web holder is disposed intermediate of the needles 22, 24, and serves the usual function of preventing knitted loops on the needles from rising with the needles, when they are elevated to latch clearing level to receive the strands in their hooks.

Disposed above the web holder 132 is a latch guard 138 mounted to a yoke 140, the spaced depending legs of which are secured to the outside surfaces of bracket 122. Vertical slots 142 formed in the spaced legs of the yoke 140 permit vertical adjustment of the latch guard 138.

As best shown in FIG. 2, the lower ends of the needles 22, 24 are formed with butts 23, 25. A crank 90 is mounted eccentrically to the bevel gear 89 of idler pulley 86 and extends upwardly to connect to the butt 23 of needle 22. Similarly, a crank 96 is mounted eccentrically to an inner horizontal extension 95 of idler pulley 92, and extends upwardly to connect to the butt 25 of needle 24. The two cranks 90, 96 extend through an opening 55 in the horizontal member 54 of frame 50 which supports the lower portion of vertical shaft 80. When rotary motion is imparted to the idlers 86, 92, the cranks 90, 96 impart reciprocatory vertical movement to the needles 22, 24.

In the specific embodiment shown in FIGS. 1–5, the cranks 90, 96 are mounted on their respective idler pulleys 86, 92 at corresponding angular locations, so that the needles reciprocate in phase, i.e. rise to clear level together and descend to cast-off level together during knitting. However, if desired, and depending on the character of the knitted cord-like product to be produced, the cranks may be disposed 180° out of phase with each other, so that the two needles will be caused to reciprocate out of phase, whereby one rises to clear level while the other descends to cast-off level. Of course, other relative arrangements of the cranks 90, 96 are possible, if desired or required, depending on the character of the product 12 to be produced.

As will be readily understood, the speed of reciprocation of the needles depends on the positioning of the timing belt with respect to the timing pulleys. The needles will reciprocate faster when belt 102 is entrained about pulleys 76, 86, 82, 92 in the manner illustrated in FIG. 1. However, if belt 102 is entrained about the pulleys in the manner indicated by the shadow lines in FIG. 1, and thus are entrained about the large diameter idler pulley elements 88, 94, the speed of reciprocation of the needles is reduced. As previously explained, the speed ratio of the idler pulleys 86, 92 provided by the two positions of the timing belt 102 is 2:1. Hence, when belt 102 is entrained about the small diameter components 87, 93 of the idler pulleys, the needles 22, 24 will reciprocate twice as fast as when belt 102 is entrained about the large diameter components 88, 94.

Guide tube 18 is disposed at the distal end of a guide arm 150. The proximal end of the guide arm 150 is affixed by a pin 153 (FIG. 3) eccentrically to a disc 152 secured to the upper end of shaft 62, above the machine frame. The eccentric mounting of the guide arm 150 on disc 152 provides a crank action, causing the guide arm to reciprocate when shaft 62 rotates.

An inverted U-shaped bracket 154 is mounted transversely of the top of the frame 53, and provides a pivot 156 for the guide arm 150. The pivot 156 provides an oscillatory motion to the guide arm, and its guide tube 18, when shaft 62 rotates to impart reciprocatory movement to the guide arm.

Guide tube 20 is secured to the distal end of a guide arm 160, the proximal end of which is mounted eccentrically by a pin 162 to a disc 164 secured to the upper end of shaft 80, above machine frame 50. Guide arm 160 is provided with a pivot 166 affixed to the top 53 of the machine frame intermediate of shaft 80 and tube 20. Thus, both reciprocatory and oscillatory motions are imparted to the guide tube 20 due to the rotation of shaft 80.

The guide arms 150, 160 are each provided with elongated slots (FIG. 3) for reception of their respective pivots 156, 166 to permit the oscillation of guide tubes 18, 20. The closer pivots 156, 166 are to the needles, the shorter will be oscillatory strokes of the guide tubes; the greater the distance between the pivots and the needles, the greater will be the oscillatory travel of the tubes.

Guide arm 160 is of roughly triangular configuration, with guide tube 20 mounted at the center of the bowed base of the triangle. The base area of guide arm 160 is open at 168 to provide clearance for the guide tube 18 affixed to the distal end of guide arm 150. The shape of opening 168 in the base area of guide arm 160 is such as to ensure at all times ample clearance for the guide tube 18.

Figure 3:
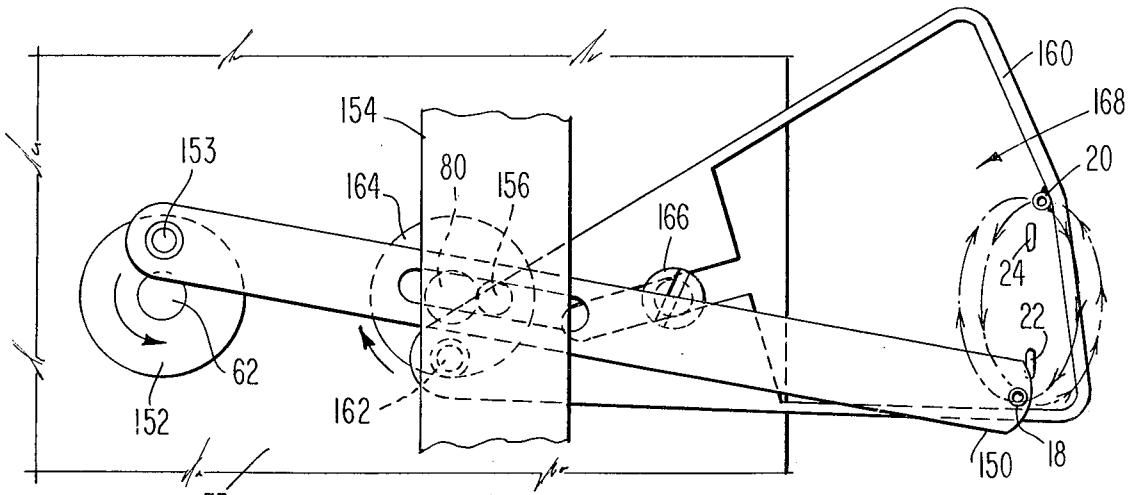
FIG. 3 is an enlarged fragmentary view in top plan indicated by the arrows III — III in FIG. 1.

By reason of the combined reciprocatory and oscillatory motions imparted to the guide tubes 18, 20, each travels in an elliptical path about the needles 22, 24, as illustrated by the broken lines in FIG. 3. The pins 153, 162 mounted on the discs 152, 164, providing the crank effect for the guide arms 150, 160, are disposed 180° out of phase. By reason of this arrangement, and the reverse rotation of the shafts 62, 80, the guide tubes 18, 20 move in opposing directions along their respective elliptical paths to wrap their strands about the needles during knitting.

When the timing belt 102 is arranged as illustrated in FIGS. 1 and 2, the needles 22, 24 will complete two full reciprocatory cycles during the period of time the guide tubes 18, 20 complete one full cycle of movement. As illustrated in FIG. 2, each time the guide tubes 18, 20 reach the end of an oscillatory stroke, both needles are at clear level for the reception of the strands 14, 16, preparatory to the formation of new knitted loops.

The knitted cord-like product 12 produced by the machine 10 is a two wale, two yarn knitted chain like that illustrated in McNamee U.S. Pat. No. 2,064,074. If desired, one of the strands 14, 16 and one of the needles 22, 24 may be inactivated or eliminated, whereby the machine is operable to produce, from a single strand with a single needle, a knitted chain of a single wale, such as illustrated in Kelsea U.S. Pat. No. 19,283. In such case, the timing belt 102 would be entrained about the timing pulleys in the manner illustrated by the shadow lines in FIGS. 1 and 5 thereby imparting a speed ratio of 1:1 to the single guide tube and needle utilized to knit the single wale chain of knitted stitches, aforesaid. With such adjustment of the timing belt 102, the needle would reach clear level, at the same time the guide tube would reach strand feeding position.

As will readily be apparent, other types of knitted cord-like structures may be produced by the machine 10. For example, a knitted yarn formed from two separate strands on a single needle, such as illustrated in Meiwald U.S. Pat. No. 2,020,197, may be made. Such a structure would be knit from strands 14, 16 by one only of the needles 22, 24. Another alternative would be to feed one only of the strands 14, 16 to both needles 22, 24 to produce a knitted yarn like that illustrated in Malis U.S. Pat. No. 2,574,701.

Figure 7:
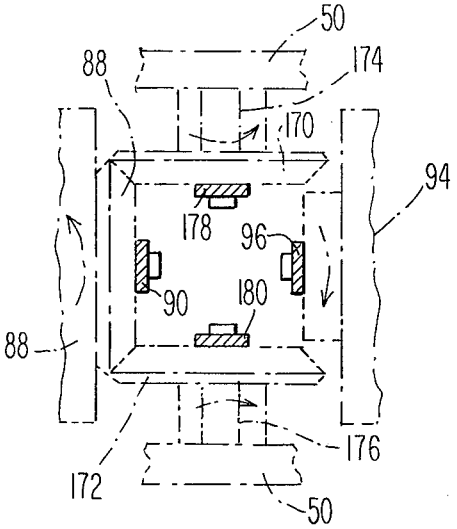
FIG. 7 is a fragmentary, schematic view indicated by the arrows VII — VII of FIG. 6.
Figure 6:
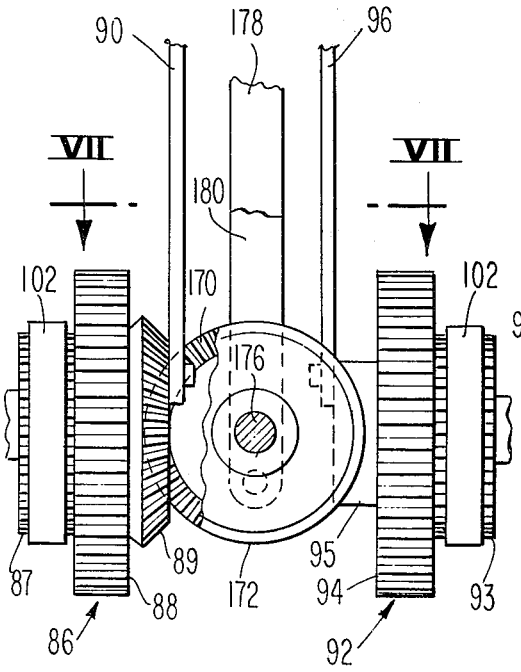
FIG. 6 is a fragmentary view in front elevation, similar to FIG. 2, showing a modification.

FIGS. 6–7 illustrate a preferred modification when the needle cylinder 110 is equipped with four vertically reciprocal needles. As shown in FIGS. 6 and 7, a pair of longitudinally spaced co-axial bevel gears 170, 172 are mounted rotatably on stud shafts 174, 176, respectively, supported by the knitting machine frame 50. The two bevel gears 170, 172 mesh with, and are driven by, the bevel gear 89 of idler pulley 86. Needle reciprocating cranks 178, 180 are mounted eccentrically to the bevel gears 170, 172, respectively, to impart reciprocatory motion to the two additional needles 184, 186 (FIG. 8). The cranks 90, 96, 178 and 180 may be disposed at selected angular locations with respect to their rotating drives, to provide reciprocatory movement to the individual needles selectively in or out of phase with each other, as desired or required.

FIGS. 8 and 9 illustrate one arrangement for feeding the two strands 14, 16 to the four needles 22, 24, 184, 186. The guide arm 160 may be replaced by a hook-like guide arm 188 having a strand feeding tube 190 disposed at its distal end. The proximal end of guide arm 188 is affixed eccentrically to disc 164 by pin 162, and is provided with an elongated slot for the reception of pivot 166.

The pivot 156 for arm 150 is advanced closer to the needles, to shorten the oscillatory stroke of guide 18. The arrangement is such that tube 18 oscillates between needles 22, 24, and hence feeds strand 14 only to needles 184, 186. The crank distance for guide arm 188, provided by the spacing of pin 162 from the center of shaft 80, is reduced sufficiently to provide a relatively short reciprocatory stroke to the guide tube 190. The reciprocatory travel of tube 190 is sufficiently shortened so that the tube reciprocates between the needles 184, 186, and hence feeds strand 16 only to needles 22, 24. The respective elliptical paths followed by guide tubes 18 and 190, in delivering their strands to the needles, are illustrated by the broken elliptic lines in FIGS. 8 and 9.

In the modification for four needle knitting shown in FIGS. 8–9, the timing belt 102 is entrained about the timing pulleys in the manner illustrated by the shadow lines in FIG. 1, to provide a 1:1 speed ratio between the cyclic travel of the needles and the cyclic travel of the strand guide tubes 18, 190. The cranks 90, 96 and 178, 180 would be disposed to cause needles 22 and 24 to reciprocate 180° out of phase with each other, and likewise to cause needles 184 and 186 to reciprocate 180° out of phase with each other. The hook-like configuration of guide arm 188 ensures that yarn guide tubes 18, 190 follow their selected elliptical paths and feed their strands to their respective needles without interference.

Figure 10:
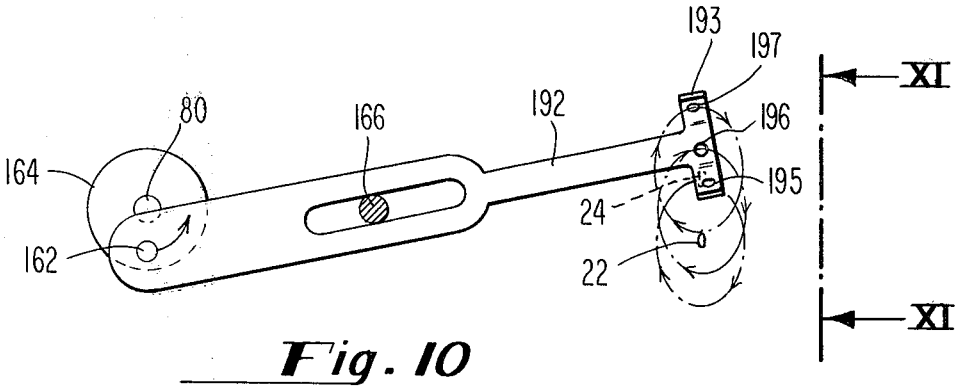
FIGS. 10 and 11 illustrate how a single yarn guide may feed plural separate strands to a pair of needles.
Figure 11:
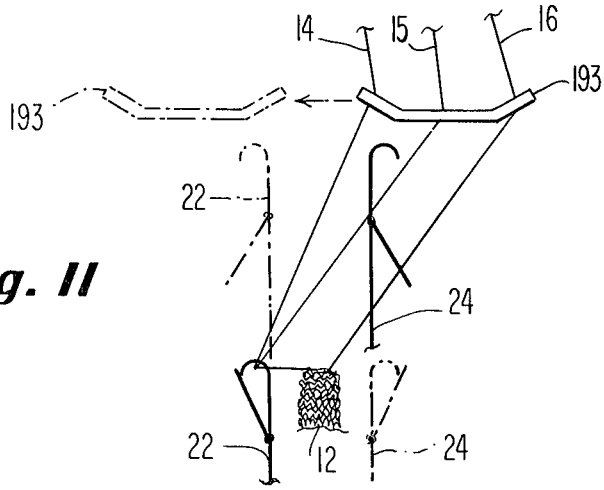

FIGS. 10 and 11 illustrate another arrangement, whereby three strands 14, 15, 16 may be fed by a single guide arm 192 to the needles 22, 24 to knit a different type of cord-like structure 12. The distal end 193 of the guide arm 192 is T-shaped and is provided with three spaced apertures 195, 196, 197, which deliver strands 14, 15, 16, respectively, to the needles.

The proximal end of guide arm 192 is affixed eccentrically by pin 162 to disc 164 on shaft 80. Oscillatory motion is provided by pivot 166. In the arrangement shown, the reciprocatory and oscillatory motions imparted to guide arm 192 are such as to cause aperture 197 to deliver strand 16 to needle 24 only, aperture 195 to deliver strand 14 to needle 22 only and aperture 196 to deliver strand 15 to both of the needles. The elliptical paths travelled by the yarn guide apertures 195, 196, 197, relative to the needles are illustrated by the broken elliptic lines in FIG. 10.

If desired, the knitting arrangement illustrated in FIGS. 10 and 11 may be modified to eliminate strand 15, thereby feeding strand 14 to needle 22 and strand 16 to needle 24 to produce simultaneously two separate, single wale knitted chains or cords of the type illustrated in Kelsea U.S. Pat. No. 19,283.

In the arrangement illustrated in FIGS. 10 and 11, timing belt 102 is entrained about the pulleys 76, 86, 92, 82 as illustrated by the shadow lines in FIG. 1, and the cranks 90, 96 (FIG. 2) are disposed 180° out of phase with each other. Each needle 22, 24 completes one full reciprocatory cycle in the same time period that yarn guide arm 192 complete one full oscillatory and reciprocatory cycle. The T-shaped distal end 193 of arm 192 reaches strand feeding position when needle 24 has ascended to clear level, to feed strands 15 and 16, or 16 only, as the case may be, to needle 24. Similarly end 193 will be in position to feed strands 14 and 15, or 14 alone, as the case may be, to needle 22 when it reaches clear level. The limits of the oscillatory travel of distal end 193 of arm 192, and of the reciprocatory travel of needles 22, 24, are illustrated by the broken line configurations in FIG. 11.

In FIGS. 12–15, the knitting machine 10 has been modified to produce a knitted cord-like product 212 directly from a roving or sliver of staple fibers 214. The positive yarn feeding means 40 is replaced by a conventional fiber drafting arrangement 240, which includes two spaced pairs of drafting nip rolls 242, 244. One each of each pair of nip rolls 242, 244 is secured to the upper end, respectively, of the vertical shafts 200, 202, mounted for rotation in a rearward extension 250 of the knitting machine frame 50. The shafts 200, 202 are driven from shaft 62 by means of a suitable drive system, including pulley 66, belt 71 and pulley 68 affixed to the lower end of shaft 200. A spur gear 204 affixed to shaft 200 meshes with idler gear 206 which, in turn, meshes with driven gear 208 affixed to the lower end of shaft 202, to impart rotation to that shaft. Idler gear 206 is rotatable about a stud shaft 210 mounted in the lower portion of frame extension 250. The ratios of the gears 204, 206, 208 are selected to produce the desired differential speed of rotation of the pairs of nip rolls 242, 244, to draft the roving 214 to any selected size sliver for knitting.

Figures 12, 13, 14, 15:
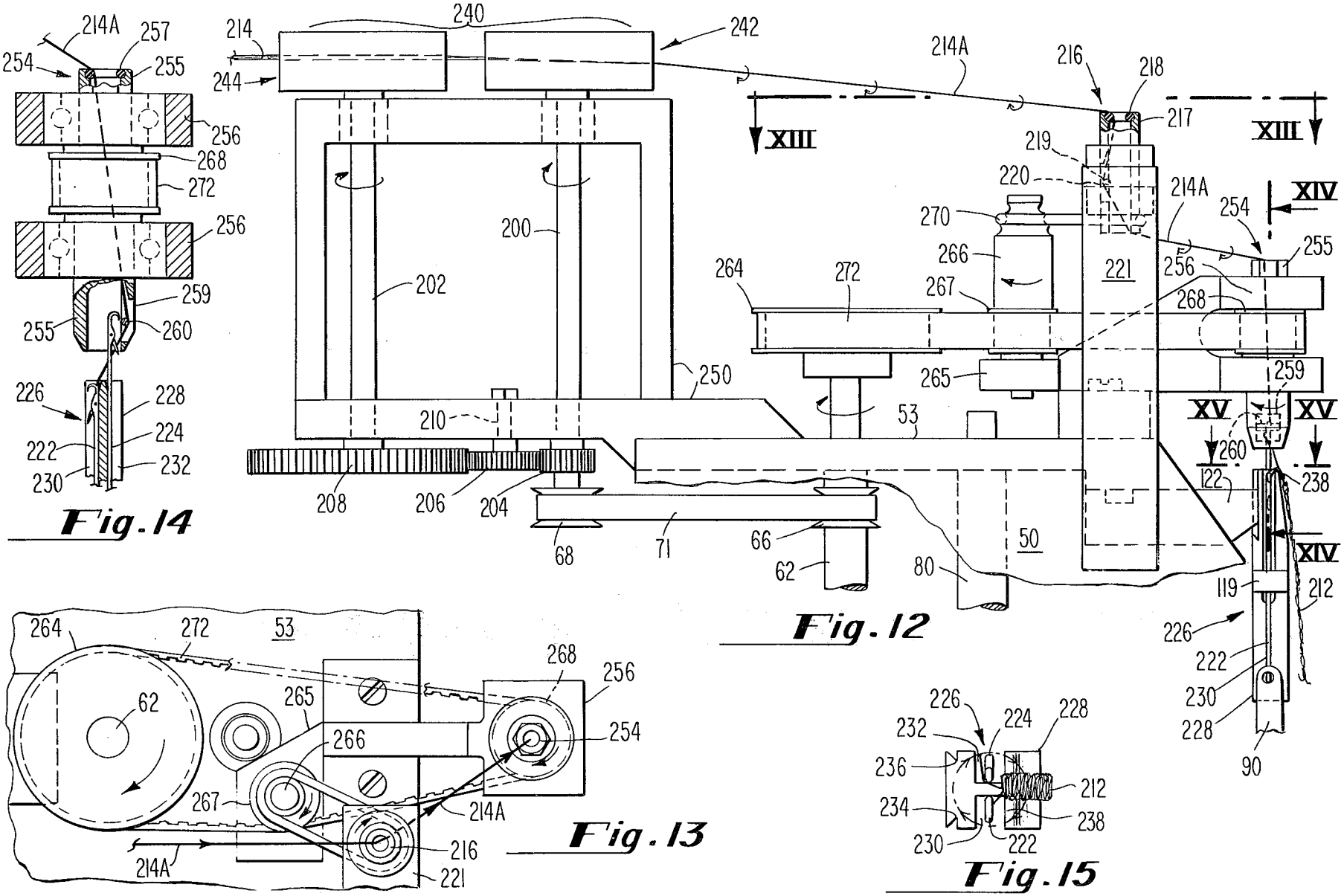
FIG. 12 is a fragmentary view in side elevation, showing the machine of FIG. 1 modified to knit cord-like structures directly from a roving of sliver fibers.
FIG. 13 is a fragmentary view in top plan indicated by the arrows XIII — XIII of FIG. 12.
FIG. 14 is an enlarged fragmentary sectional view in front elevation indicated by the arrows XIV — XIV of FIG. 12.
FIG. 15 is an enlarged fragmentary view in section, showing the top of the needle cylinder, indicated by the arrows XV — XV of FIG. 12.

The drafted sliver 214A is formed into a two-wale chain of knitted stitches 212 by a pair of back-to-back needles 222, 224 mounted for vertical reciprocatory movement in a specially designed needle cylinder 226. The needle cylinder consists basically of an elongated rectangular element 228 having vertical needle slots 230, 232 formed in its lateral faces. As best shown in FIG. 15, the needle slots 230, 232 are relatively deep, so that the needles 222, 224 are spaced relatively close to each other. Such proximate location of the needles to each other is advantageous when knitting relatively weak strands, such as the drafted roving 214A.

The needles 222, 224 are caused to reciprocate in their needle slots 230, 232, 180° out of phase, by the cranks 90, 96 in the manner previously explained. A clamp 119 retains the needles in their slots during reciprocation. Bifurcated bracket 122 supports the needle cylinder 226, with capacity for selected vertical adjustment, by the dovetail mounting arrangement previously explained. For this purpose, the rear portions of the lateral faces of the rectangular element 228 are formed with vertically extending angular grooves 234, 236 (FIG. 15) which engage slidably with complemental angular grooves formed in the distal end of bracket 122.

The upper portion of the front face of the rectangular element 228 is tapered in the direction of the needles, to provide a relatively thin, horizontal top edge or verge 238 for the needle cylinder 226. With this arrangement, and the close proximity of the needles 222, 224, the chain 212 of knitted stitches formed by the needles is cast off the side of the needles, over the verge 238, as illustrated in FIG. 12, and wound up on a conventional take-up mechanism (not shown). The unique provision of the verge 238, permitting lateral cast-off of the knitted loops, to the sides of the needles, rather than to the rear thereof, facilitates the close disposition of the needles 222, 224 to each other for the knitting of the highly fragile drafted sliver 214A of staple fibers.

The drafted sliver 214A travels from the second pair of nip rolls 242 to and through a rotatable false twister 216 (FIG. 12) and then passes to a rotary guide 254, which wraps the sliver onto the needles 222, 224. The false twister 216 comprises a hollow vertical tube 217 having an O-ring 218 mounted internally of its upper end. The O-ring is made of rubber or any synthetic material of similar properties, and aids in the imparting of a false twist to the drafted sliver 214A. The tube 217 is provided with an intermediate opening 219 in which is mounted a chordal pin 220. The sliver 214A passes over the curved surface of O-ring 218, into the hollow of tube 217, thence into the opening 219 around pin 220 and back into the lower portion of opening 219, and then passes downwardly through the remainder of tube 217, from which it travels to the rotary guide 254. The false twister 216 is supported rotatably by a bracket 221 affixed by any conventional means to the knitting machine frame 50.

The rotary guide 254 comprises a hollow vertical rotatable tube 255 supported for rotation by a bifurcated bracket 256 secured to the upper portion 53 of the machine frame 50. As best shown in FIG. 14, an O-ring 257 of rubber or similar material is disposed internally of tube 255 at its upper end. An opening 259 is disposed in tube 255 near its lower end, and is provided with a chordal pin 260. The sliver 214A passes over the curved surface of the O-ring 257 into the hollow of the tube 255, then passes into opening 259, around pin 260 and back through the opening 259 into the hollow of tube 255.

As is best illustrated in FIG. 14, the cranks 90, 96 raise the needles 222, 224 to yarn clearing level within the lower portion of the hollow of rotatable tube 255 of the rotary guide 254. Preferably, the hooks of the needles are raised to a level slightly above the pin 260. This ensures that the sliver 214A passing around pin 260 and back through the opening 259 is wrapped around the needle, between its hook and latch, by the rotating guide 254, as the needle begins its descent to cast-off level. The elevation of the needles to clear level within the hollow of the rotary guide, to receive the drafted and false twisted sliver 214A in their hooks, as the sliver passes from pin 260, aids in preventing the fragile strand of sliver from breaking during knitting.

Affixed to the top of shaft 62, above the top 53 of the machine frame, is a toothed timing pulley 264. Mounted on an extension 265 of bracket 256 is a vertical rotatable shaft 266 having affixed thereto a toothed timing pulley 267. Affixed to the rotary guide 254, intermediate the bifurcations of bracket 256, is a toothed timing pulley 268. An endless toothed timing belt 272 is entrained about pulleys 264, 267, 268. An endless drive belt 270 extends from the upper portion of shaft 266 to the lower portion of the false twister 216. By means of the drive arrangement just described, shaft 62 imparts rotation to the rotary guide 254 via pulley 264, timing belt 272 and pulley 268. Rotation is imparted from shaft 62 to the false twister 216 via pulley 264, belt 272, pulley 267, shaft 266 and belt 270. The timing arrangement, by the selection of timing pulleys 264, 268, causes the rotary guide 254 to make several complete revolutions during each reciprocatory cycle of the needles 222, 224. In practice, it is preferred that rotary guide 254 makes at least three complete revolutions during one complete needle reciprocatory cycle, although speed ratios of 4:1 or higher usefully may be employed.

The selection of the size of the timing pulley 267, with respect to timing pulley 264, and the dimensions of the driving connection between shaft 266 and the false twister 216, by belt 270, preferably are such as to cause the false twister also to make several complete revolutions per complete needle reciprocatory cycle. A preferred speed ratio of rotation of the false twister 216 to one complete reciprocatory needle cycle is on the order of 10:1.

In the arrangement illustrated in FIGS. 12–15, both the false twister 216 and the rotary guide 254 produce a false twist effect in the drafted sliver 214A. Such effect tends to strengthen the sliver as it is delivered to the rotary guide 254 to be wrapped about the needles 222, 224 by the guide 254. In the absence of such false twist effect, the highly fragile drafted sliver 214A is prone to breakage during delivery to the rotary guide.

However, it is within the scope of this invention to eliminate entirely the false twister 216, and deliver sliver 214A directly to the rotary guide 254. In such arrangement, the timing of the drive system between shaft 62 and the rotary guide 254 preferably should be modified to increase the speed of the rotary guide per reciprocatory cycle of the needles.

The rotary yarn guide 254 is readily adaptable for use with the knitting machine illustrated in FIGS. 1–5, in substitution for the yarn guide arms 150, 160 when only a single strand is to be delivered to the needles. In such an arrangement, where the strand does not comprise a roving or sliver, it is not necessary for the rotary guide to be rotated at such speed as to impart a false twist to the strand. For example, if rotary guide 254 is employed to deliver a single strand to needles 22, 24, with the needles reciprocating out of phase as illustrated in FIG. 11, the speed ratio of the rotary guide to the needles would be 1:1. If the rotary guide 254 is employed to deliver a single strand to only one of the needles 22, 24 the speed ratio also would be 1:1. Such speed ratios, as will be readily understood, may be provided either through suitable adjustment of the timing belt 102, as previously explained, or by the proper selection of timing pulleys disposed respectively, on shaft 62 and the rotary guide, connected by a suitable timing belt.

Although certain preferred embodiments of our invention have been shown and described for the purposes of illustration, and to explain the versatility of the invention, it is to be understood that the invention has a wide range of applicability and uses, and that various changes and modifications may be made without departing from the spirit and utility of the invention, or the scope thereof as set forth in the appended claims.

In the claims which follow, the terms "cord-like structures" and "strands" are not intended to be restricted in scope or meaning, but are intended to include yarn, thread, continuous filaments, spun filaments, roving, sliver and all like or similar textile products.

We claim:

1. A machine for knitting cord-like structures having
a. at least one needle,
b. at least one movable guide for delivering a strand to the needle,
c. a crank for imparting reciprocatory movement to the needle,
d. a timing pulley connective operatively to the crank to drive the crank,
e. a shaft for imparting strand delivery movement to the guide,
f. the crank and the shaft having axes disposed in directions transverse to each other,
g. a timing pulley connected to the shaft and
h. an endless twisted timing belt connecting the shaft pulley to the crank pulley for driving the needle crank to cause the needle to reciprocate in timed relation to the strand delivery movement of the guide.

2. The machine of claim 1 wherein the guide is rotary, and is caused by the shaft to rotate relative to the needle in timed relation to the reciprocatory movement of the needle.

3. The machine of claim 1 wherein the shaft is provided with a crank to impart reciprocatory strand delivery movement to the guide in timed relation to the reciprocatory movement of the needle.

4. The machine of claim 3 further including a pivot for the guide to impart oscillatory strand delivery movement to the guide simultaneously with the reciprocatory movement imparted to the guide.

5. The machine of claim 1 wherein each timing pulley has at least two different timing components adapted to be connected selectively by the timing belt, for changing selectively the speed ratio of the needle to the guide.

6. The machine of claim 1 further including positive strand feeding means for metering the strand delivered by the guide to the needle.

7. The machine of claim 1 further including
a. a support frame for the machine and
b. a drive unit mounted on the frame for driving the shaft.

8. The machine of claim 1 wherein the strand is a roving of staple fibers, and further including
a. a drafting system for the roving,
b. a rotary guide for delivering the drafted roving to the needle,
c. drive means connecting the shaft to the guide for imparting rotary motion to the guide and
d. means associated with the rotary guide to impart a false twist to the drafted roving as the roving is delivered to the needle.

9. The machine of claim 8 further including a false twist device interposed between the drafting system and the rotary guide to impart a false twist to the drafted roving as it passes to the guide.

10. The machine of claim 9 further including
a. a second timing pulley connected to the shaft,
b. a timing pulley for the rotary guide,
c. a timing pulley for the false twist device and
d. an endless timing belt entrained about all three of said timing pulleys to impart rotation to the false twist device and to the rotary guide in timed relation to the reciprocatory movement of the needle.

11. The machine of claim 8 further including means for casting off knitted loops formed by the needle laterally of the needle.

12. The machine of claim 11 wherein the cast-off means is a verge disposed laterally of the needle.

13. The machine of claim 8 wherein the rotary guide includes
a. a rotatable tube,
b. an opening in the tubular wall,
c. a chordal pin disposed in the opening about which the drafted roving passes en route to the needle and
d. a hollow in the tube proximate the pin for reception of the needle as the needle is raised to yarn clearing level 14. A machine for knitting cord-like structures having
a. a pair of needles,
b. a pair of movable guides for delivering strands to the needles,
c. a pair of co-axial horizontal axis cranks for imparting reciprocatory movement to the needles,
d. a timing pulley connected operatively to each crank to drive the cranks,
e. a pair of spaced vertical axis shafts for imparting strand delivery movements to the guides,
f. a timing pulley connected to each shaft and
g. an endless twisted timing belt entrained about all the timing pulleys to cause the needles to reciprocate in timed relation to the strand delivery movements of the guides.

15. The machine of claim 14 wherein each timing pulley is a compound pulley to vary the speed ratio of the needles to the guides.

16. The machine of claim 14 wherein each shaft is provided with a crank for imparting reciprocatory strand delivery movement to the guides in timed relation to the reciprocatory movement of the needles.

17. The machine of claim 14 further including a pivot for each guide to impart oscillatory strand delivery movement to the guides simultaneously with the reciprocatory movement imparted to the guides.

18. The machine of claim 14 further including
a. a second pair of needles,
b. a second pair of cranks for imparting reciprocatory movement to the second pair of needles and
c. drive means for the second pair of cranks connecting the cranks operatively to one of the timing pulleys for the first mentioned cranks.

19. A machine for knitting cord-like structures from at least one strand comprising:
a. a support frame for the machine,
b. a drive unit mounted on the frame,
c. at least one needle having capacity for reciprocatory movement,
d. first drive means connecting said drive unit and said needle for imparting reciprocatory movement to the needle,
e. said first drive means including a rotating crank connected to the needle for imparting movement to the needle,
f. at least one strand guide for wrapping a strand about the needle during its reciprocatory movement, to form a chain of knitted stitches from the strand, and
g. second drive means connecting said drive unit and said strand guide for imparting simultaneously reciprocatory and oscillatory strand delivery movements to the guide,
h. said second drive means including a rotating crank connected to the strand guide for imparting movement to the strand guide.

20. The machine of claim 19 further including a plurality of needles and a plurality of guides for feeding a plurality of strands to the needles.

21. The machine of claim 19 wherein the drive means connecting the drive unit to the needles includes timing means for reciprocating the needles at the same cyclic rate at which the guides reciprocate and oscillate.

22. The machine of claim 19 wherein the drive means connecting the drive unit to the needles includes timing means for reciprocating the needles at a cyclic rate which is different from the rate at which the guides reciprocate and oscillate.

23. The machine of claim 19 further including timing means to cause the needle to reciprocate in timed relation to the reciprocation and oscillation of the guide.

24. The machine of claim 23 wherein said timing means includes timing pulleys in each of said first and second drive means and a common endless twisted timing belt entrained about the timing pulleys to cause the pulleys to rotate in selected timed relation to each other.

25. A machine for knitting cord-like structures directly from a roving of staple fibers comprising
a. at least one needle,
b. drafting means for the roving,
c. a rotary yarn guide disposed between the drafting means and the needle for delivering drafted roving to the needle, d. a rotatable drive shaft, e. first drive means connecting the shaft to the needle for imparting reciprocatory movement to the needle and f. second drive means connecting the shaft to the rotary guide for imparting rotary motion to the guide in timed relation to the reciprocatory movement of the needle, g. said two drive means being driven in timed relation to each other.

26. The machine of claim 25 having means associated with the rotary guide for imparting a false twist to the drafted roving as the roving is delivered to the needle.

27. The machine of claim 25 wherein the roatry guide makes a plurality of complete revolutions during each reciptocatory cycle of the needle.

28. The machine of claim 25 wherein the rotary guide imparts a false twist to the sliver.

29. The machine of claim 25 further including a false twist device interposed between the drafting means and the rotary guide to impart a false twist to the roving.

30. The machine of claim 25 further including a. a support frame for the machine, b. a drive unit mounted on the frame for driving the shaft and c. a third drive means connecting the shaft to the drafting means for driving the drafting means in timed relation to the rotation of the guide.

31. The machine of claim 25 further including a. a pair of needles disposed in close parallel relationship to each other, b. a rotary guide adapted to deliver roving to each of the needles and c. means for casting off knitted loops formed by the needles laterally of the needles.

32. The machine of claim 31 further including a crank for each needle for imparting reciprocatory movement to the needles and wherein the first drive means includes a. a timing pulley for each crank, b. a timing pulley mounted on the shaft and c. an endless twisted timing belt connecting the shaft pulley to the crank pulleys.

* * * * *